US006756733B2

(12) United States Patent
Kim et al.

(10) Patent No.: US 6,756,733 B2
(45) Date of Patent: Jun. 29, 2004

(54) PLASMA DISPLAY PANEL

(75) Inventors: Young-mo Kim, Kyungki-do (KR); Hidekazu Hatanaka, Kyungki-do (KR); Won-tae Lee, Kyungki-do (KR); Yoon-jeong Lee, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 106 days.

(21) Appl. No.: 10/107,244

(22) Filed: Mar. 28, 2002

(65) Prior Publication Data

US 2003/0184229 A1 Oct. 2, 2003

(51) Int. Cl.[7] ..... H01J 17/49
(52) U.S. Cl. ..... 313/587; 313/586
(58) Field of Search ..... 313/587, 586, 313/584; 315/169.4; 345/41, 60

(56) References Cited

U.S. PATENT DOCUMENTS 6,611,099 B1 * 8/2003 Murata et al. ..... 313/582
2002/0063526 A1 * 5/2002 Mizobata ..... 313/586

* cited by examiner

*Primary Examiner*—Ashok Patel
(74) *Attorney, Agent, or Firm*—Burns, Doane, Swecker & Mathis, L.L.P.

(57) ABSTRACT

In a plasma display panel, front and rear substrates are arranged separated a predetermined distance from each other and to face each other, forming a discharge space. A plurality of first electrodes are formed on an inner surface of the rear substrate. A first dielectric layer is formed on the inner surface of the rear substrate to cover the first electrodes. A plurality of barrier ribs are formed between the first electrodes on the inner surface of the rear substrate, sectioning the discharge space. A fluorescent substance layer is formed on a surface of the first dielectric layer and side surfaces of the barrier ribs. A first protective film formed on the surface of the first fluorescent layer. A plurality of second electrodes are formed corresponding to the first electrodes on an inner surface of the front substrate. A second dielectric layer formed on the inner surface of the front substrate to cover the second electrodes. A second fluorescent layer formed on the surface of the second dielectric layer. A second protective film is formed on the surface of the second fluorescent layer. A predetermined discharge gas sealed in the discharge space. Thus, a discharge voltage can be reduced and deterioration of fluorescent substance can be prevented. Also, generation of visual rays increases to improve brightness.

21 Claims, 5 Drawing Sheets

PLASMA DISPLAY PANEL

Priority is claimed to patent application No. 2001-58761 filed in Rep. of Korea on Oct. 6, 2000, herein incorporated by reference.

BACKGROUND OF THE INVENTION

1. Field of the Invention

The present invention relates to a plasma display panel, and more particularly, to a plasma display panel having an improved structure so that visual rays having high brightness is generated at a low discharge voltage and deterioration of a fluorescent substance can be reduced.

2. Description of the Related Art

Plasma display panels are apparatuses for displaying desired numbers, letters or graphic by exciting fluorescent substances by ultraviolet rays generated from plasma.

The plasma display panel is classified into a DC type and an AC type according to the type of a driving voltage applied to a discharge cell, for example, the types of discharge.

In a DC type plasma display panel, all electrodes are exposed to a discharge space so that electric charges are moved directly between the corresponding electrodes. In an AC type plasma display panel, at least one electrode is covered with a dielectric layer and electric charges do not move directly between corresponding electrodes. Instead, discharge is performed by wall charges.

An example of an AC type plasma display panel is shown in FIGS. 1 and 2. Referring to the drawings, a plurality of first electrodes 12 are formed parallel to one another in the first direction on an inner surface of a rear substrate 10. A first dielectric layer 14 is formed on the inner surface of the rear substrate 10 to cover the first electrodes 12. A plurality of barrier ribs 16 for sustaining a discharge distance and preventing electric, optical crosstalk between neighboring discharge cells are formed on an upper surface of the first dielectric layer 14 between the first electrodes 12. Also, a fluorescent substance layer 18 is formed on the upper surface of the first dielectric layer 14 and the side surfaces of the barrier ribs 16.

A front substrate 20 is coupled to the rear substrate 10 to form a discharge space sectioned by the barrier ribs 16. A plurality of second electrodes 13 are formed parallel to one another and perpendicular to the first electrodes 12 on an inner surface of the front substrate 20. A second dielectric layer 15 is formed on the inner surface of the front substrate 20 to cover the second electrodes 13. A protective film 25 is formed on a surface of the second dielectric layer 20. The discharge space formed by coupling the front substrate 20 and the rear substrate 10 is filled with a discharge gas 30 which generates ultraviolet rays during discharge.

The dielectric layers 14 and 15 achieve a high discharge intensity and a memory effect by repeating an electron avalanche phenomenon of wall charges charged on the surface of the dielectric layers. Meanwhile, since the dielectric layers 14 and 15 formed in a thick film method such as print is not dense, plasma intrudes into the dielectric layers through gaps and damages the electrodes (ion bombardment phenomenon). Thus, the protective film 25 prevents the ion bombardment phenomenon and is formed into a dense structure in a thin film method such as deposition. Here, the protective film 25 is formed of MgO having a superior secondary electron emission effect in a deposition method. The MgO protective film not only prevents damage to the dielectric layers due to sputtering of plasma particles, but also lowers a discharge voltage and a sustain voltage by the secondary electron emission. Also, a discharge gas 30 sealed in the discharge space generates ultraviolet rays having a wavelength of about 147 nm during discharge. In general, a penning gas mixture of He, Ne, Ar, or a gas mixture thereof, and a small amount of Xe gas which becomes a source of the generation of ultraviolet rays is used as the discharge gas.

However, the plasma display panel having the above structure cannot prevent deterioration of the fluorescent substance due to ion collision generated on the rear substrate. Also, since the ultraviolet rays are projected toward the rear substrate to excite the fluorescent substance layer and then visual rays generated thereby is reflected by a reflection layer of the rear substrate and projected toward the front substrate, the dielectric layer and electrodes located on the front substrate serve as an obstruction transmission of light so that brightness is lowered.

SUMMARY OF THE INVENTION

To solve the above-described problems, it is an object of the present invention to provide a plasma display panel in which a discharge space is filled with a discharge gas including a gas generating ultraviolet rays having a long wavelength during discharge, and a fluorescent substance layer and a protective film are independently formed on each of the front and rear substrates, so that brightness increases, a discharge voltage is reduced, and deterioration of the fluorescent substance is prevented.

To achieve the above object, there is provided a plasma display panel comprising a front substrate and a rear substrate arranged separated a predetermined distance from each other and to face each other, forming a discharge space, a plurality of first electrodes formed on an inner surface of the rear substrate, a first dielectric layer formed on the inner surface of the rear substrate to cover the first electrodes, a plurality of barrier ribs formed between the first electrodes on the inner surface of the rear substrate, sectioning the discharge space, a fluorescent substance layer formed on a surface of the first dielectric layer and side surfaces of the barrier ribs, a first protective film formed on a surface of the fluorescent substance layer, a plurality of second electrodes formed corresponding to the first electrodes on an inner surface of the front substrate, a second dielectric layer formed on the inner surface of the front substrate to cover the second electrodes, a second protective film formed on the surface of the second dielectric layer, and a predetermined discharge gas sealed in the discharge space.

To achieve the above object, there is provided a plasma display panel comprising a front substrate and a rear substrate arranged separated a predetermined distance from each other and to face each other, forming a discharge space, a plurality of first electrodes formed on an inner surface of the rear substrate, a first dielectric layer formed on the inner surface of the rear substrate to cover the first electrodes, a plurality of barrier ribs formed between the first electrodes on the inner surface of the rear substrate, sectioning the discharge space, a first fluorescent substance layer formed on a surface of the first dielectric layer and side surfaces of the barrier ribs, a plurality of second electrodes formed corresponding to the first electrodes on an inner surface of the front substrate, a second dielectric layer formed on the inner surface of the front substrate to cover the second electrodes, a second fluorescent substance layer formed on a surface of the second dielectric layer, a second protective film formed on the surface of the second dielectric layer, and a predetermined discharge gas sealed in the discharge space.

It is preferred in the present invention that the plasma display panel further comprises a first protective film formed on a surface of the first fluorescent substance layer.

It is preferred in the present invention that the discharge gas includes a gas generating ultraviolet rays having a long wavelength of 147 nm or more during discharge.

It is preferred in the present invention that the discharge gas includes a gas generating ultraviolet rays having a long wavelength of 200 nm or more during discharge.

It is preferred in the present invention that the thickness of the first protective film is 100 through 500 nm.

It is preferred in the present invention that the thickness of the second fluorescent substance layer is 1 through 20 $\mu$m.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
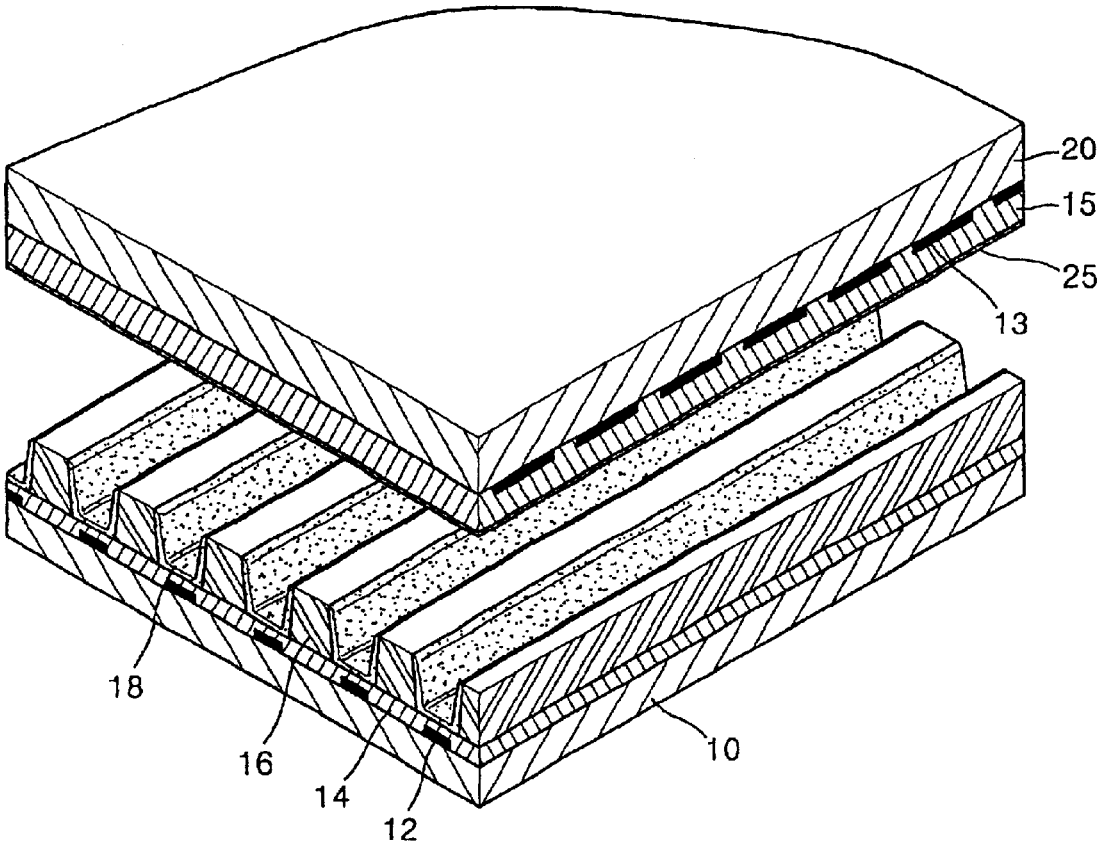
FIG. 1 (PRIOR ART)
FIG. 1 is a perspective view showing an example of a conventional plasma display panel.
Figure 2:
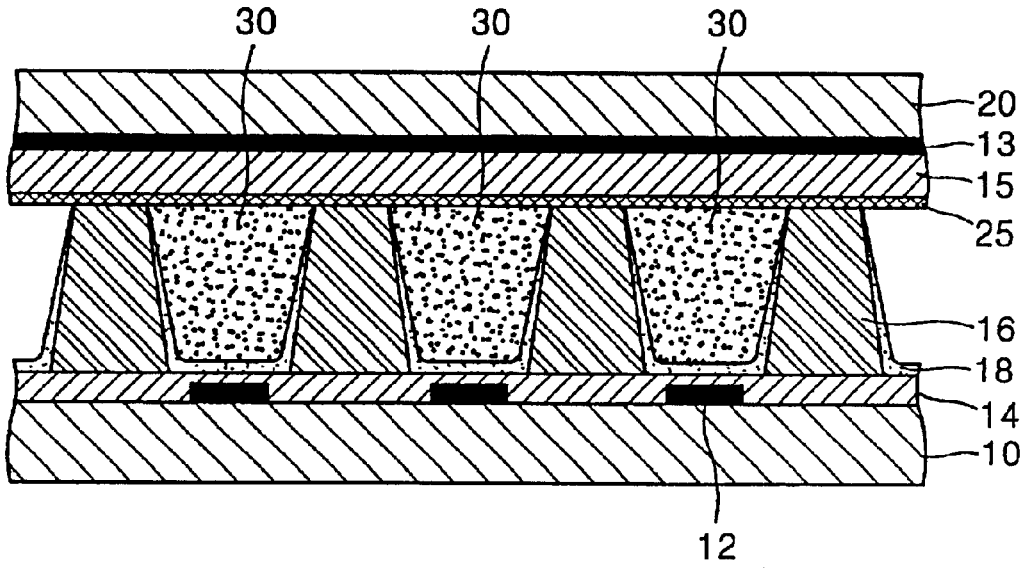
FIG. 2 (PRIOR ART)
FIG. 2 is a sectional view of the plasma display panel of FIG. 1.
Figure 3:
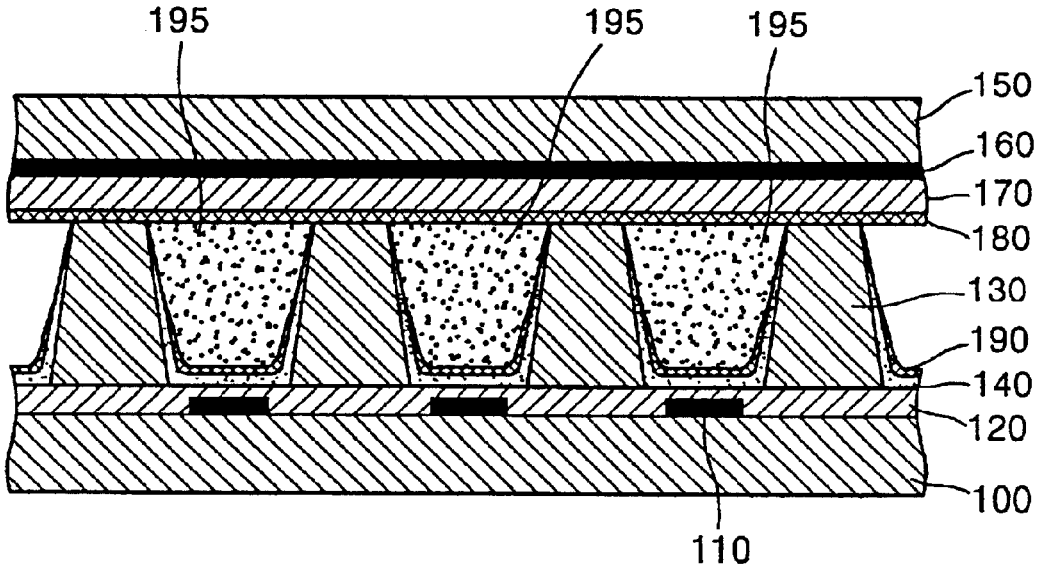
FIG. 3 is a sectional view of a plasma display panel according to a first preferred embodiment of the present invention.

Referring to FIG. 3, in a plasma display panel according to a first preferred embodiment of the present invention, a front substrate 150 and a rear substrate 100 are arranged separated a predetermined distance from each other and to face each other. A plurality of first electrodes 110 are formed parallel to one another on an inner surface of the rear substrate 100. A first dielectric layer 120 is formed on the inner surface of the rear substrate 100 to cover the first electrodes 110. Also, a plurality of barrier ribs 130 having a predetermined height to prevent crosstalk are formed on the inner surface of the rear substrate 100 between the first electrodes 110. A fluorescent substance layer 140 is formed on an upper surface of the first dielectric layer 120 and the side surfaces of the barrier ribs 130. A first protective film 190 is formed on a surface of the fluorescent substance layer 140.

The front substrate 150 is coupled to the rear substrate 100 to form a discharge space sectioned by the barrier ribs 130. A plurality of second electrodes 160 are formed corresponding to the first electrodes 110 on an inner surface of the front substrate 150. A second dielectric layer 170 is formed on the inner surface of the front substrate 150 to cover the second electrodes 160. Also, a second protective film 180 is formed on a surface of the second dielectric layer 170. The discharge space formed by coupling the front substrate 150 and the rear substrate 100 is filled with a discharge gas 195 which generates ultraviolet rays during discharge.

The dielectric layers 120 and 170 achieve a high discharge intensity and a memory effect by repeating an electron avalanche phenomenon of wall charges charged on the surface of the dielectric layers. The second protective film 180 formed of a MgO protective film prevents damage of the second dielectric layer 170 due to sputtering of plasma particles and lowers a discharge voltage due to emission of secondary electrons.

In the present invention, a gas generating ultraviolet rays having a long wavelength of 147 nm or more, preferably, 200 nm or more, is used as the discharge gas 195 sealed in the discharge space. The ultraviolet rays having a long wavelength is used as a source to excite the fluorescent substance. As the discharge gas, for example, a Xe gas mixture generates ultraviolet ray having a wavelength of 254 nm. In the case of a NeXe gas mixture, as a portion of Xe increases, a ratio that ultraviolet rays having a wavelength of 173 nm is generated during discharge increases. The ultraviolet rays of a long wavelength exhibits a superior fluorescent excitation feature because it has a high transmittance with respect to a MgO protective film. In the particular case of ultraviolet rays having a wavelength of 200 nm or more, transmittance is nearly 100%.

Also, a MgO protective film is formed on the surface of the fluorescent substance layer 140 as a first protective film 190. The first protective film 190 not only reduces a discharge voltage by emission of secondary electrons, but also prevents deterioration of the fluorescent substance due to ion collision so that life span of the fluorescent substance can be extended. Here, the thickness of the first protective film 190 is preferably 100 through 500 nm. To prove the above effects, a test was performed using a NeXe gas mixture including 4% of Xe as a discharge gas under the pressure of 600 mbar. The result is that the maximum discharge sustain voltage is 218 V when no MgO protective film is present while the maximum discharge sustain voltage is 205 V when the MgO protective film is present. Therefore, when the MgO protective film is present, the maximum sustain voltage is reduced by about 6%.

Figure 4:
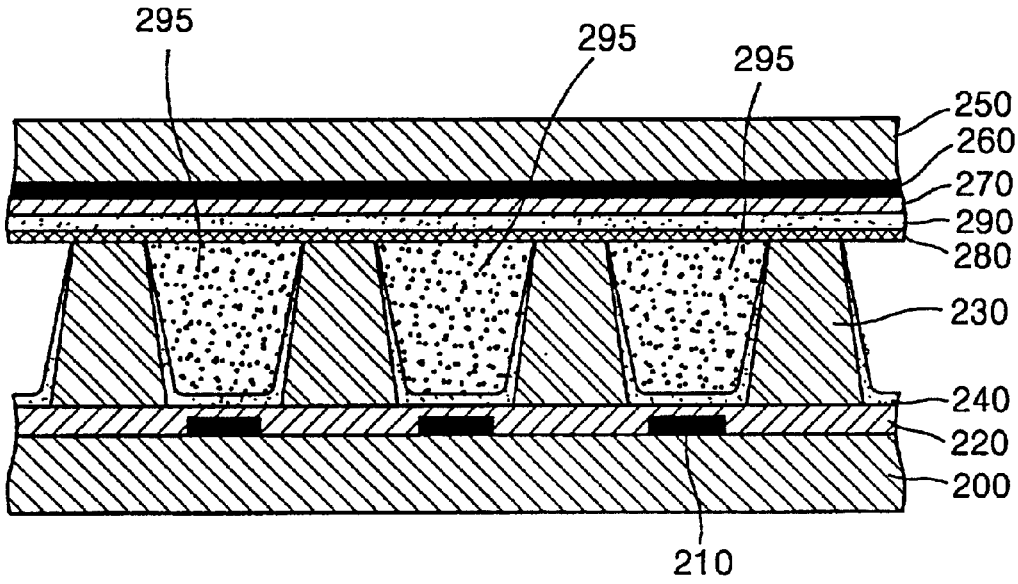
FIG. 4 is a sectional view of a plasma display panel according to a second preferred embodiment of the present invention.

FIG. 4 shows a plasma display panel according to another preferred embodiment of the present invention. Referring to the drawing, a plurality of first electrodes 210 are formed parallel to one another on an inner surface of the rear substrate 200. A first dielectric layer 220 is formed on the inner surface of the rear substrate 200 to cover the first electrode 210. Also, a plurality of barrier ribs 230 having a predetermined height are formed on the inner surface of the rear substrate 200 between the first electrodes 210. A first fluorescent substance layer 240 is formed on an upper surface of the first dielectric layer 220 and the side surfaces of the barrier ribs 230.

The front substrate 250 is coupled to the rear substrate 200 to form a discharge space sectioned by the barrier ribs 230. A plurality of second electrodes 260 are formed corresponding to the first electrodes 210 on an inner surface of the front substrate 250. A second dielectric layer 270 is formed on the inner surface of the front substrate 250 to cover the second electrodes 260. A second fluorescent substance layer 290 is formed on the inner surface of the second dielectric layer 270. A protective film 280 is formed on a surface of the second fluorescent substance layer 290. The discharge space formed by coupling the front substrate 250 and the rear substrate 200 is filled with a discharge gas 295 which generates ultraviolet rays during discharge.

The discharge gas 295 sealed in the discharge space includes a gas generating ultraviolet rays having a long wavelength which exhibits a high transmittance with respect to a MgO protective film.

The second fluorescent substance layer 290 formed between the second dielectric layer 270 and the protective film 280 increases generation of visual rays by excitation of ultraviolet rays. Here, the thickness of the second fluorescent substance layer 290 is preferably set to 1 through 20 $\mu$m to minimize the effect of blocking visual rays by the fluorescent substance and simultaneously maximize generation of visual rays by excitation of ultraviolet rays. When the thickness of the second fluorescent substance layer 290 is 15 $\mu$m, the transmittance of visual rays is about 80%.

Figure 5:
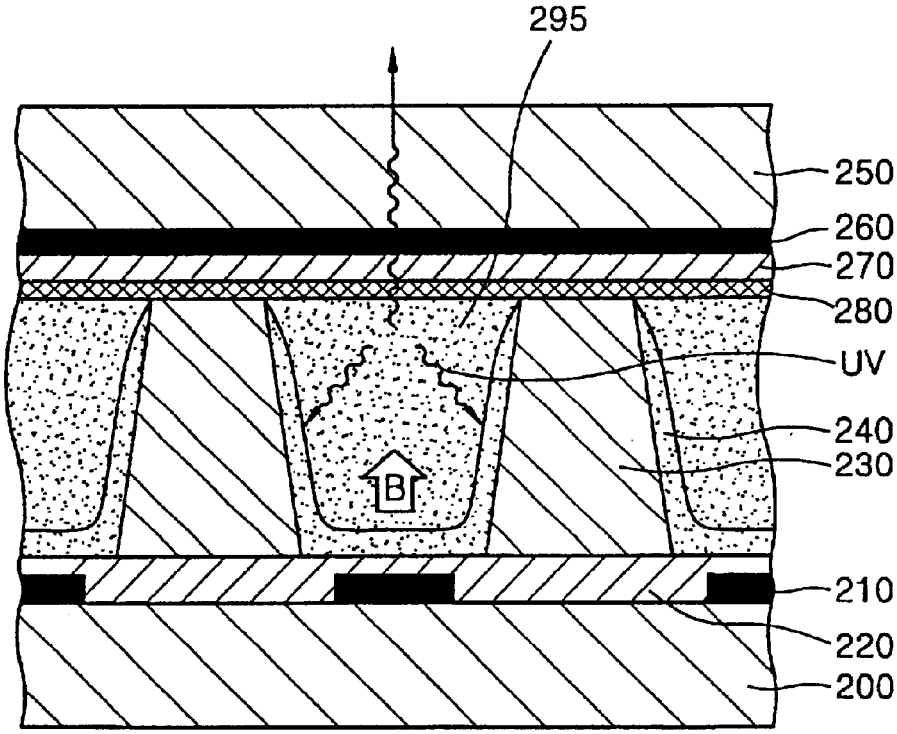
FIG. 5 is a sectional view of a plasma display panel when the second fluorescent substance layer is not formed on the front substrate.
Figure 6:
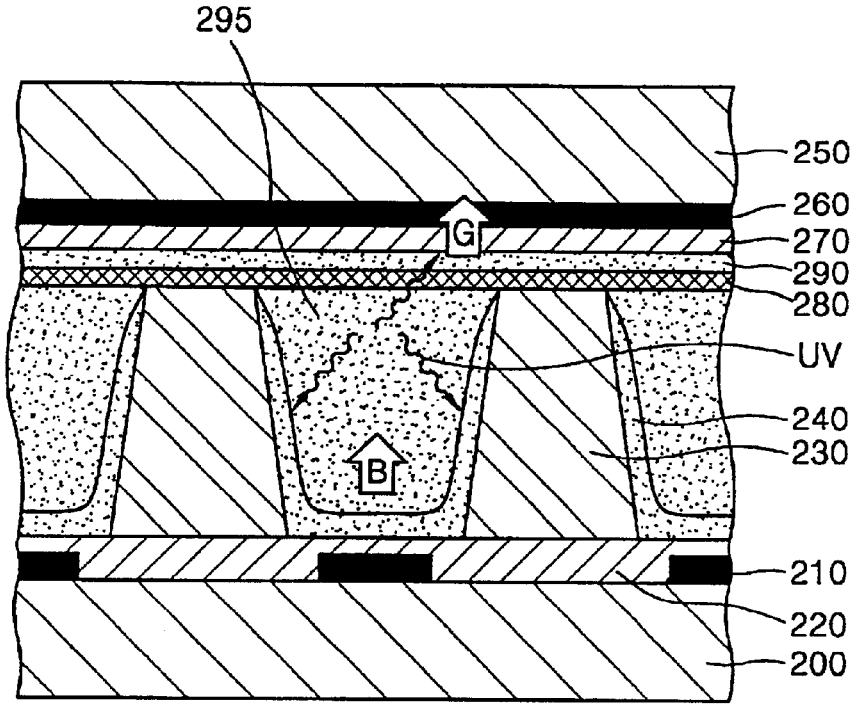
FIG. 6 is a sectional view of a plasma display panel when the second fluorescent substance layer is formed on the front substrate.
Figure 7:
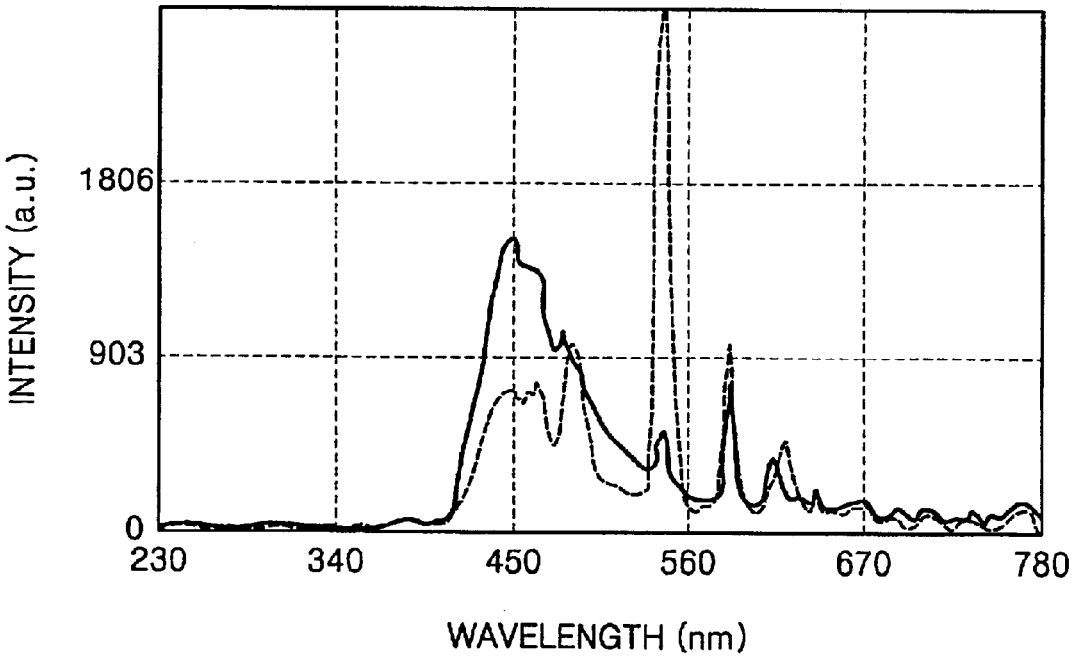
FIG. 7 is a graph showing the intensity of visual rays generated in the cases of FIG. 5 and FIG. 6.

FIGS. 5 through 7 are views for explaining an effect of increase of visual rays as the second fluorescent substance layer is formed on the front substrate.

FIGS. 5 and 6 show the case in which the second fluorescent substance layer is not formed on the front substrate and the case in which the second fluorescent substance layer is formed on the front substrate, respectively. To discriminate visual rays generated from the rear substrate 200 and the front substrate 250, a blue fluorescent substance layer is formed on the rear substrate 200 as the first fluorescent substance layer 240 while a green fluorescent substance layer is formed on the front substrate 250 as the second fluorescent substance layer 290. Also, the discharge gas 295 generating ultraviolet rays having a wavelength of 200 nm or more during discharge is sealed in the discharge space.

First, when the second fluorescent substance layer 290 is not formed on the front substrate 250, as shown in FIG. 5, part of ultraviolet rays generated from the discharge space transmit the front substrate 250. The remaining ultraviolet rays excite the blue fluorescent substrate layer formed on the rear substrate 200 to generate blue light rays B.

Next, when the second fluorescent substance layer 290 is formed on the front substrate 250, as shown in FIG. 6, ultraviolet rays generated from the discharge space and proceeding toward the front substrate 250 excite the green fluorescent substance layer formed on the front substrate 250 to generate green light rays G. Simultaneously, the remaining ultraviolet rays excite the blue fluorescent substrate layer formed on the rear substrate 200 to generate blue light rays B.

FIG. 7 is a graph showing the relationship between the intensity of visual rays generated in the cases of FIG. 5 and FIG. 6. In the drawing, a solid line indicates the intensity of visual rays generated in the case of FIG. 5 while a dotted line indicates the intensity of visual rays generated in the case of FIG. 6. Referring to the graph, in the case in which the second fluorescent substance layer 290 is formed on the front substrate 250, the intensity of blue light rays decreases slightly while the intensity of the green light rays increases greatly, compared to the case in which the second fluorescent substance layer 290 is not formed. Thus, on the whole, brightness of visual rays increases by about 25%.

Figure 8:
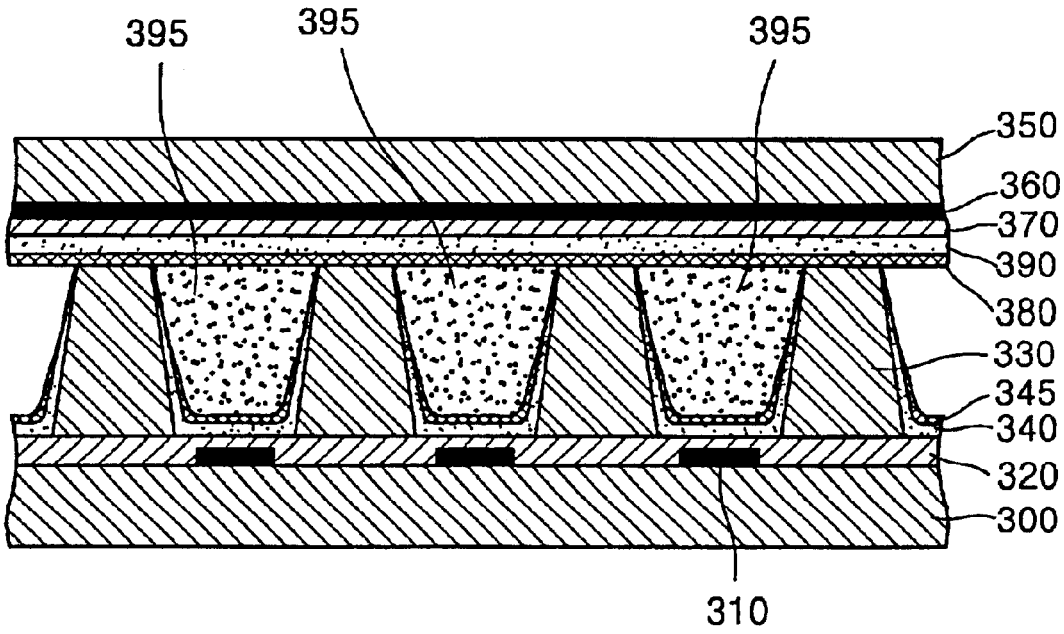
FIG. 8 is a section view of a plasma display panel according to a third preferred embodiment of the present invention.

FIG. 8 shows a plasma display panel according to yet another preferred embodiment of the present invention, in which the above-described two preferred embodiments are combined.

Referring to the drawing, a plurality of first electrodes 310 are formed parallel to one another on an inner surface of the rear substrate 300. A first dielectric layer 320 is formed on the inner surface of the rear substrate 300 to cover the first electrodes 310. Also, a plurality of barrier ribs 330 having a predetermined height are formed on the inner surface of the rear substrate 300 between the first electrodes 310. A first fluorescent substance layer 340 is formed on an upper surface of the first dielectric layer 320 and the side surfaces of the barrier ribs 330. A first protective film 345 is formed on a surface of the first fluorescent substance layer 340.

The front substrate 350 is coupled to the rear substrate 300 to form a discharge space sectioned by the barrier ribs 330. A plurality of second electrodes 360 are formed corresponding to the first electrodes 310 on an inner surface of the front substrate 350. A second dielectric layer 370 is formed on the inner surface of the front substrate 350 to cover the second electrodes 360. A second fluorescent substance layer 390 is formed on the inner surface of the second dielectric layer 370. A second protective film 380 is formed on a surface of the second fluorescent substance layer 390. The discharge space formed by coupling the front substrate 350 and the rear substrate 300 is filled with the discharge gas 395 which generates ultraviolet rays having a long wavelength during discharge.

In the above structure, the discharge gas 395, the first protective film 345, and the second fluorescent substance layer 390 are the same as those described above.

As described above, in the plasma display panel according to the present invention, a discharge gas generating ultraviolet rays having a long wavelength during discharge is sealed in the discharge space and additional protective film is provided on the fluorescent substance layer on the rear substrate. Thus, a discharge voltage due to an increase of emission of secondary electrons can be reduced and deterioration of the fluorescent substance due to ion collision is prevented to extend the life span of the fluorescent substance. Also, by providing additional fluorescent substance layer between the dielectric layer and the protective layer on the front substrate, more visual rays are generated by being excited by ultraviolet rays so that brightness is improved.

What is claimed is:

1. A plasma display panel comprising:

a front substrate and a rear substrate arranged separated a predetermined distance from each other and to face each other, forming a discharge space;

a plurality of first electrodes formed on an inner surface of the rear substrate;

a first dielectric layer formed on the inner surface of the rear substrate to cover the first electrodes;

a plurality of barrier ribs formed between the first electrodes on the inner surface of the rear substrate, sectioning the discharge space;

a fluorescent substance layer formed on a surface of the first dielectric layer and side surfaces of the barrier ribs;

a first protective film formed on a surface of the fluorescent substance layer;

a plurality of second electrodes formed corresponding to the first electrodes on an inner surface of the front substrate;

a second dielectric layer formed on the inner surface of the front substrate to cover the second electrodes;

a second protective film formed on the surface of the second dielectric layer; and a predetermined discharge gas sealed in the discharge space;

wherein the thickness of the first protective film is 100 through 500 nm.

2. A plasma display panel comprising:

a front substrate and a rear substrate arranged separated a predetermined distance from each other and to face each other, forming a discharge space;

a plurality of first electrodes formed on an inner surface of the rear substrate;

a first dielectric layer formed on the inner surface of the rear substrate to cover the first electrodes;

a plurality of barrier ribs formed between the first electrodes on the inner surface of the rear substrate, sectioning the discharge space;

a first fluorescent substance layer formed on a surface of the first dielectric layer and side surfaces of the barrier ribs;

a plurality of second electrodes formed corresponding to the first electrodes on an inner surface of the front substrate;

a second dielectric layer formed on the inner surface of the front substrate to cover the second electrodes;

a second fluorescent substance layer formed on a surface of the second dielectric layer;

a second protective film formed on the surface of the second fluorescent substance layer; and a predetermined discharge gas sealed in the discharge space.

3. The plasma display panel as claimed in claim 2, wherein the discharge gas includes a gas generating ultraviolet rays having a long wavelength of 147 nm or more during discharge.

4. The plasma display panel as claimed in claim 3, wherein the discharge gas includes a gas generating ultraviolet rays having a long wavelength of 200 nm or more during discharge.

5. The plasma display panel as claimed in claim 4, wherein the thickness of the second fluorescent substance layer is 1 through 20 $\mu$m.

6. The plasma display panel as claimed in claim 5, further comprising a first protective film formed on a surface of the first fluorescent substance layer.

7. The plasma display panel as claimed in claim 6, wherein the discharge gas includes a gas generating ultraviolet rays having a long wavelength of 147 nm or more during discharge.

8. The plasma display panel as claimed in claim 7, wherein the discharge gas includes a gas generating ultraviolet rays having a long wavelength of 200 nm or more during discharge.

9. The plasma display panel as claimed in claim 8, wherein the thickness of the second fluorescent substance layer is 1 through 20 $\mu$m.

10. The plasma display panel as claimed in claim 9, wherein the thickness of the first protective film is 100 through 500 nm.

11. The plasma display panel as claimed in claim 8, wherein the thickness of the first protective film is 100 through 500 nm.

12. A plasma display panel comprising:

a first substrate and a second substrate arranged separated a predetermined distance from each other and to face each other, forming a discharge space;

a plurality of first electrodes formed on an inner surface of the second substrate;

a first dielectric layer formed on the inner surface of the second substrate to cover the first electrodes;

a plurality of barrier ribs formed between the first electrodes on the inner surface of the second substrate, sectioning the discharge space;

a first fluorescent substance layer formed on a surface of the first dielectric layer and side surfaces of the barrier ribs;

a plurality of second electrodes formed corresponding to the first electrodes on an inner surface of the first substrate;

a second dielectric layer formed on the inner surface of the first substrate to cover the second electrodes;

a second fluorescent substance layer formed on a surface of the second dielectric layer;

a second protective film formed on the surface of the second fluorescent substance layer; and a predetermined discharge gas sealed in the discharge space.

13. The plasma display panel as claimed in claim 12, wherein the discharge gas includes a gas generating ultraviolet rays having a long wavelength of 147 nm or more during discharge.

14. The plasma display panel as claimed in claim 13, wherein the discharge gas includes a gas generating ultraviolet rays having a long wavelength of 200 nm or more during discharge.

15. The plasma display panel as claimed in claim 14, wherein the thickness of the second fluorescent substance layer is 1 through 20 $\mu$m.

16. The plasma display panel as claimed in claim 12, further comprising a first protective film formed on a surface of the first fluorescent substance layer.

17. The plasma display panel as claimed in claim 16, wherein the discharge gas includes a gas generating ultraviolet rays having a long wavelength of 147 nm or more during discharge.

18. The plasma display panel as claimed in claim 17, wherein the discharge gas includes a gas generating ultraviolet rays having a long wavelength of 200 nm or more during discharge.

19. The plasma display panel as claimed in claim 18, wherein the thickness of the second fluorescent substance layer is 1 through 20 $\mu$m.

20. The plasma display panel as claimed in claim 19, wherein the thickness of the first protective film is 100 through 500 nm.

21. The plasma display panel as claimed in claim 18, wherein the thickness of the first protective film is 100 through 500 nm.

* * * * *